US005249790A

United States Patent [19]

Brame et al.

[11] Patent Number: 5,249,790

[45] Date of Patent: Oct. 5, 1993

[54] APPARATUS FOR SEPARATING THIN FLAT ARTICLES

[75] Inventors: Thierry Brame, La-Ferte-Saint-Aubin; Christian Galateau, Jouy-le-Potier, both of France

[73] Assignee: Komori-Chambon, Orleans-La-Source, France

[21] Appl. No.: 868,454

[22] Filed: Apr. 14, 1992

[30] Foreign Application Priority Data

Apr. 18, 1991 [FR] France ..... 91 04807

[51] Int. Cl.[5] ..... B65H 29/68

[52] U.S. Cl. ..... 271/182; 271/189; 271/202

[58] Field of Search ..... 271/182, 189, 69, 202

[56] References Cited

U.S. PATENT DOCUMENTS

| | | | |
|---|---|---|---|
| 3,804,403 | 4/1974 | Vogt | 271/182 |
| 3,998,141 | 12/1976 | Hsiue | 271/202 |
| 4,040,617 | 8/1977 | Walkington | 271/202 |
| 4,133,523 | 1/1979 | Berthelot | 271/182 |
| 4,409,741 | 10/1983 | Bonomi | 271/182 |
| 5,039,083 | 8/1991 | Senn | 271/182 |

FOREIGN PATENT DOCUMENTS

| | | | |
|---|---|---|---|
| 1939233 | 2/1971 | Fed. Rep. of Germany . | |
| 1574805 | 6/1969 | France . | |
| 111870 | 5/1987 | Japan | 271/202 |

*Primary Examiner*—Robert P. Olszewski
*Assistant Examiner*—Steven M. Reiss
*Attorney, Agent, or Firm*—McAulay Fisher Nissen Goldberg & Kiel

[57] ABSTRACT

An apparatus is disclosed for separating thin, flat articles, such as blanks of cardboard displaced successively, in a continuous line, on at least one conveyor. This apparatus is characterized in that it comprises, opposite the conveyor, a lever for hooking the articles, mounted to rotate about a transverse, horizontal axis, this lever bearing, on the one hand, a claw for holding the articles, and, on the other hand, at least one connecting rod extending longitudinally downstream, mounted to rotate on the lever, about a transverse horizontal axis, and carrying, in its downstream part, at least one wheel bearing on the articles located on the conveyor, each wheel being made so as to present a low rotational inertia, and a spring is provided between the connecting rod and the lever.

17 Claims, 3 Drawing Sheets

APPARATUS FOR SEPARATING THIN FLAT ARTICLES

FIELD OF THE INVENTION

The present invention relates to an apparatus for separating thin, flat articles, such as blanks of cardboard or like material cut out from a continuous web, displaced successively, in a continuous line, on at least one conveyor, so as to create, downstream of the apparatus, groups of articles separated from one another by intervals or "holes" in the line of articles.

BACKGROUND OF THE INVENTION

The separation apparatus according to the invention is particularly applicable in a line for the mass-production of individual cardboard blanks intended subsequently to constitute packings for various products. Such a production line comprises, upstream, a flat or rotary apparatus for cutting out a continuous web of cardboard in order to produce, downstream, from this web, at least one line of cut-outs or "blanks" which are then displaced downstream, preferably in the manner of "scales", i.e. overlapping one another on a conveyor. Such a blank production line often comprises, at its downstream end, a receiving apparatus intended to form, from the continuous line of blanks, stacks of blanks each comprising a predetermined number of blanks. Consequently, in order to allow formation of these stacks of blanks, it is necessary to separate each continuous line of blanks into groups of successive blanks each comprising the same predetermined number of blanks intended to constitute, downstream, an individual stack of blanks. This device which is intended to constitute an empty space or "hole" in the line of blanks is controlled by a blank counter disposed in the vicinity of the conveyor on which the blanks are placed in the manner of "scales".

Patent FR-A-2 597 847 already discloses an apparatus for separating blanks of cardboard which is disposed in the zone of connection of two longitudinal conveyors located at the same level, namely an upstream conveyor bringing the cardboard blanks superposed in a "scale"-like manner, coming from a cut-out apparatus, and a downstream conveyor moving at a higher speed, for driving the groups of blanks separated by the apparatus. This separation apparatus, of relatively complex structure, comprises vertically mobile means disposed both above and below the horizontal plane containing the upper sides of the conveyors and being able to be displaced by jacks, in order to raise by lower means, at the moment when the blanks must be separated, the line of blanks to stop it against an upper stop then lowered by control means.

The present invention relates to improvements to such a type of separation apparatus in order to simplify the construction thereof whilst ensuring an efficient drive of the blanks on the downstream conveyor and a stop, without risk of disorder, of blanks with an irregular leading edge.

SUMMARY OF THE INVENTION

To that end, this apparatus for separating thin, flat articles, such as blanks of cardboard or of like material cut out from a continuous web, displaced successively, in a continuous line, on at least one conveyor, so as to create, downstream of the apparatus, groups of articles separated from one another by intervals or "holes" in the line of articles, is characterized in that it comprises, opposite the conveyor, a lever for hooking the articles, mounted to rotate about a transverse, horizontal axis, between an inactive position and an active, or article-hooking, position, this lever bearing, on the one hand, a claw for holding the articles, and, on the other hand, at least one connecting rod extending longitudinally downstream, mounted to rotate on the lever, about a transverse horizontal axis, and bearing, in its downstream part, at least one wheel bearing on the articles located on the conveyor, in that each wheel is made so as to present a low rotational inertia and in that a spring is provided between the connecting rod and the lever so as to urge the wheel elastically in the direction of the conveyor.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
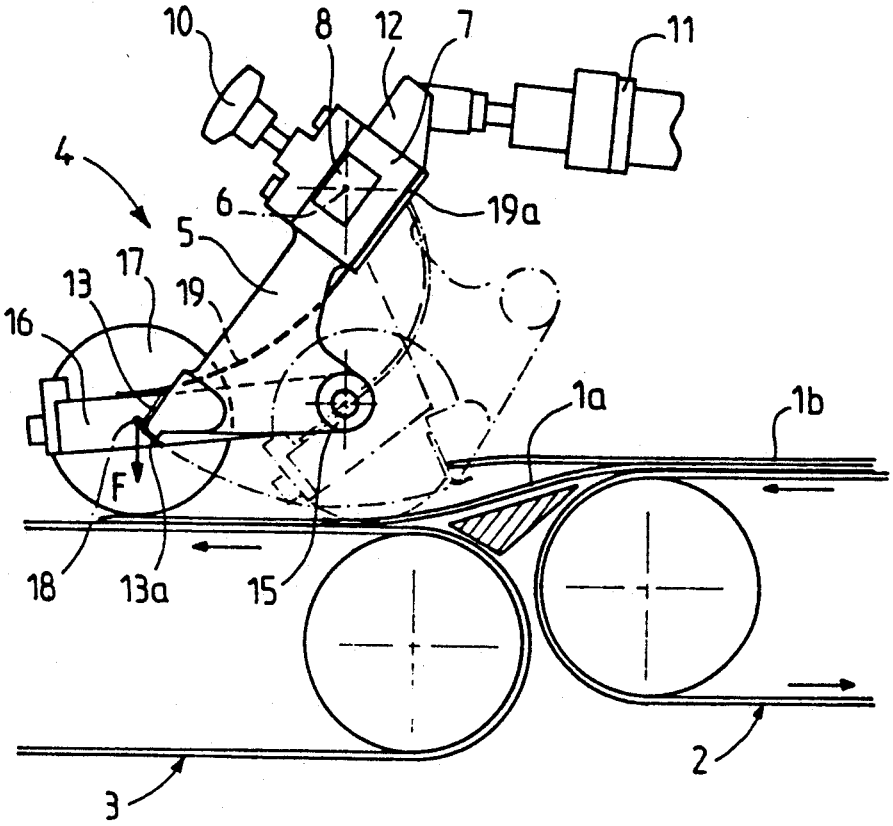
FIG. 1 is a view in a vertical, longitudinal section of an apparatus for separating cardboard blanks in an inactive position, during passage of a continuous line of blanks.
Figure 2:
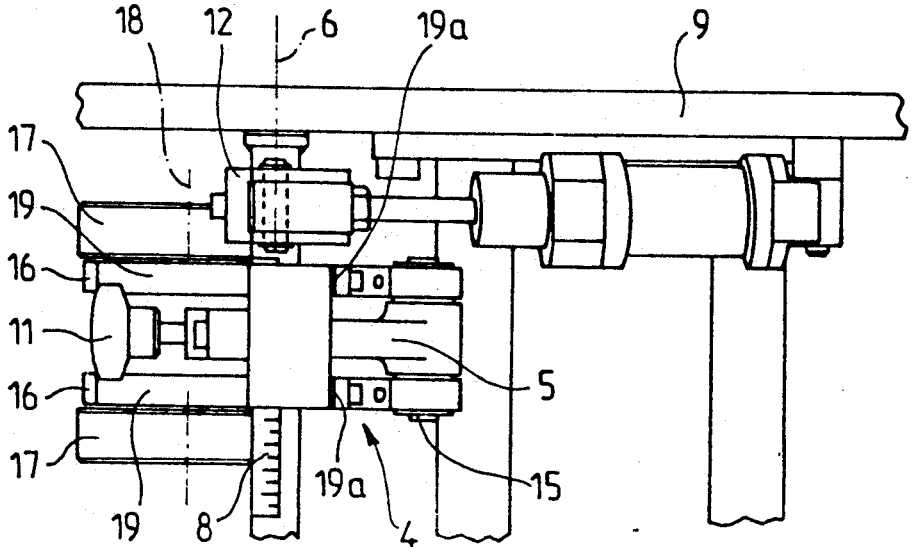
FIG. 2 is a partial plan view of the apparatus in an intermediate position between its inactive and active positions.
Figure 3:
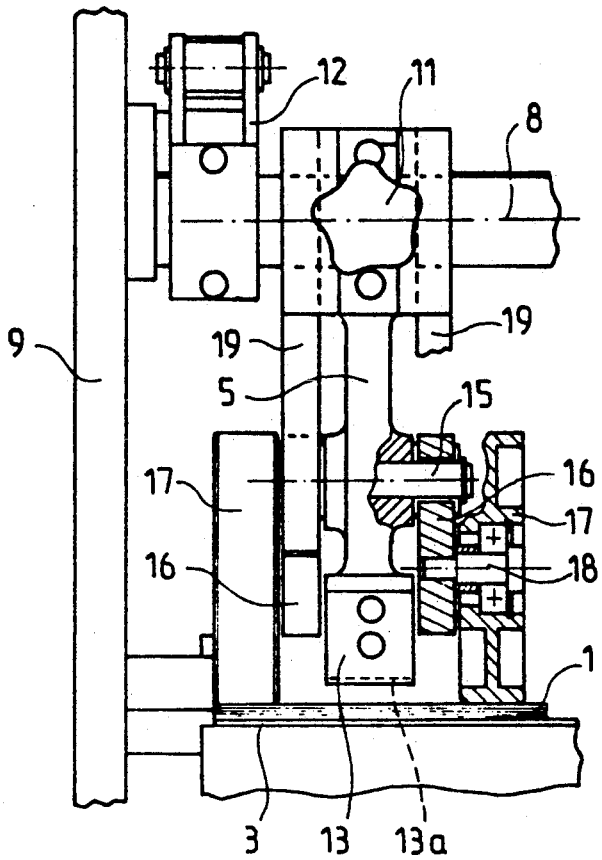
FIG. 3 is a partial view in a vertical, longitudinal section along line III—III of FIG. 2.
Figure 4:
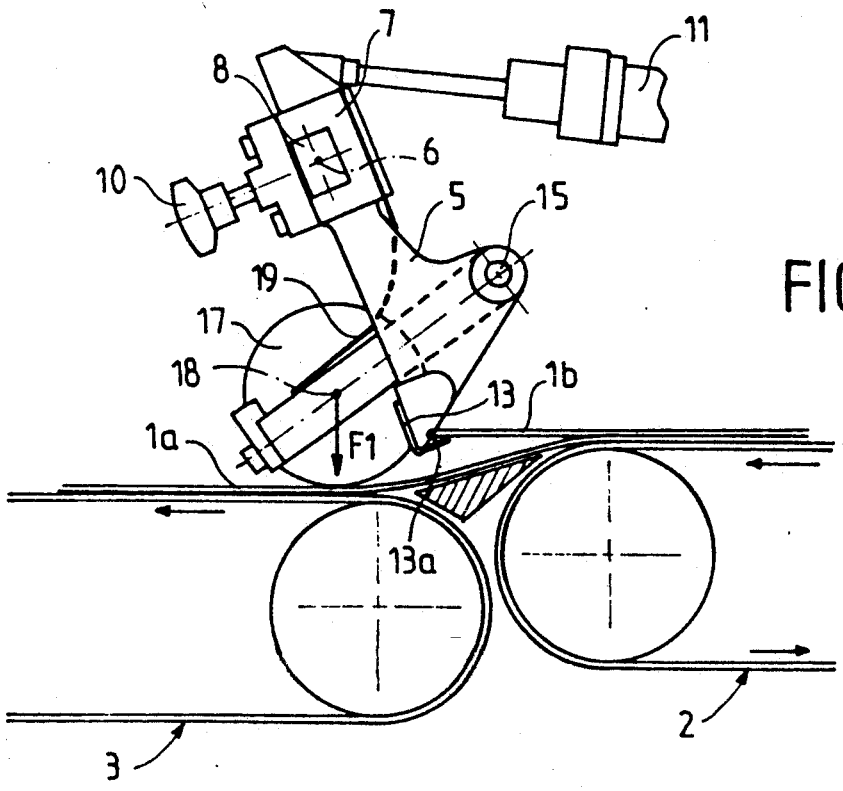
FIG. 4 is a view in a vertical, longitudinal section of the separation apparatus, in an active position in which it stops the line of blanks arriving upstream.

Referring now to the drawings, the separation apparatus according to the invention which is shown in FIGS. 1 to 4, is intended to separate a continuous line of flat, thin articles, such as cardboard blanks, into groups each comprising a predetermined number of blanks and which are intended to constitute respectively, downstream, individual stacks of blanks. These blanks, of which only two successive blanks, namely a preceding blank 1*a* and a following blank 1*b*, are shown in FIGS. 1 and 4, are displaced, from right to left in the drawing, by an upstream longitudinal endless conveyor 2 and they then pass onto another downstream longitudinal endless conveyor 3, aligned with the preceding one and which is located slightly lower than the upstream conveyor 2 in order to provoke a slight "gaping" between the successive blanks, such "gaping" facilitating separation of the groups of blanks. The separation apparatus according to the invention, which is generally designated by reference 4, is located completely above the upstream end part of the downstream conveyor 3. It comprises, for each line of blanks which are preferably conveyed in "scale" manner, i.e. overlapping one another, at least one module which is controlled by a blank counter (not shown) placed in an appropriate position to detect the number of blanks having to constitute each stack.

The separation apparatus 4 comprises a lever 5 for hooking the blanks which is normally inclined downwardly and from upstream to downstream in an inactive position, as shown in FIG. 1. This lever 5 is mounted to rotate, in its upper part, about a transverse horizontal pin 6 defining a transverse horizontal axis and, to that end its upper end forms a thicker hub 7 traversed right through by a transverse horizontal support rod 8. This transverse support rod 8, which is solid or hollow having a first axis 6 formed by the center of horizontal pin 6, is mounted to rotate, at its two ends, on the frame 9 of the apparatus. The lever 5 is mounted to slide on the transverse support rod 8 and it may be immobilized, in any appropriate position, by means of a blocking member 10. Rotation of the rod 8 about its axis 6 is controlled by a jack 11 borne by the frame 9 of the apparatus and of which the rod is connected to an arm 12 fast with the support rod 8. The lever 5 bears, at its lower end located towards the downstream side, a claw 13 for holding the blanks presenting a lower tooth 13*a* which is inclined downwardly and from down stream to upstream. The distance and position of the claw 13 with respect to the axis of rotation 6 are such that its lower tooth 13*a* describes an arc of a circle, indicated in broken lines in FIG. 1, so that this tooth 13*a* is placed, in active position (FIG. 4), under the leading edge of the following blank lb. The lever 5 also bears, in its lower end part located on the upstream side, a transverse horizontal pin 15 defining a second axis around which are rotatably mounted two connecting rods 16 extending substantially horizontally and longitudinally downstream and bearing respective wheels 17 mounted to rotate about transverse horizontal pins 18, Each rod 16 is elastically urged downwardly, i.e. in an anti-clockwise direction about pin 15. Such stress is exerted by springs 19 which may be constituted, in the case of the non-limiting embodiment shown in FIGS. 1 and 2, by flexion blades whose upper end parts 19*a* are fixed on the hub 7 of the lever 5. Each flexion blade 19 is cambered and presents an upwardly facing concavity and it abuts, by its lower end part, on the upper side of a connecting rod 16.

In the inactive position, as shown in FIG. 1, the claw 13 is close to the axis of rotation 18 of the wheels 17 and it is thus retracted inside the profile of these wheels. Wheels 17 are elastically pressed, by the spring blades 19, on the blanks moving on the downstream conveyor 3 and the separation apparatus 4 merely accentuates the gaping of the blanks, which gaping is due to the difference in level of the upstream (2) and downstream (3) conveyors. In order to ensure efficient drive of the blanks 1*a*, 1*b* on the downstream conveyor 3, the intensity F of the vertical pressing effort exerted by the wheels 17 on the blanks is adjustable, by the appropriate choice of the mechanical characteristics of the springs 19 used, and the rotational inertia of these wheels 17 is reduced to a minimum in order not to penalize the placing of the downstream conveyor 3 in overspeed, which overspeed occurs during the separation operation, creating a gap or "hole" in the line of blanks. To that end, each wheel 17 is advantageously made of a light material, such as a light alloy or a plastics material.

When an operation of separating the line of blanks 1 must take place, the jack 11 is actuated, under the control of the blank counter, and its rod is then extended in order to pivot the whole of the separation apparatus 4 into its active or blank-hooking position as shown in FIG. 4. The extension of the rod of jack 11 is translated by a pivoting of the lever assembly 5 about axis 6, in anti-clockwise direction. The lever 5, after having passed through a substantially vertical intermediate position, shown in FIGS. 2 and 3, then occupies a position inclined downwardly and from downstream to upstream (FIG. 4) and in this position, the lower claw 13 extends from the profile of the bearing wheels 17 and is placed substantially above the space included between the adjacent ends of the two upstream (2) and downstream (3) conveyors. During its movement of rotation about axis 6, the tooth 13*a* of the holding claw 13 engages in the "gap" between the two succesive blanks 1*a* and 1*b* and claw 13 then encounters the leading edge of the following blank 1*b*. At the end of its movement of rotation, the tooth 13*a* of the claw 13 then raises the leading edge of the following blank 1*b*, whilst the preceding blank 1*a* continues to be driven downstream. In the hooking position (FIG. 4) the axis of rotation 18 of the wheels 17 approaches the axis of rotation 6 of the lever 5, which is obtained by pivoting each connecting rod 16 in a clockwise direction with respect to lever 5. This movement of pivoting is in turn translated by an accentuation of the camber of the spring blades 19 so that the return effort of each cambered spring blade 19 is greater in its active position than in its inactive position. In other words, in the active or hooking position (FIG. 4), each wheel 17 exerts on the last blank 1*a* of the group of preceding blanks a pressing effort F1 which is greater than the effort F normally exerted in the inactive position (FIG. 1). This increase in the pressing effort Fl is translated by a more efficient drive of the last blanks of the group of preceding blanks, at the moment of the operation of separation, whilst the downstream conveyor 3 is placed in overspeed.

Once separation is effected, the state of overspeed is eliminated, i.e. the downstream conveyor 3 returns to its normal speed, the control jack 11 is actuated in an opposite direction, which provokes retraction of its rod so that the whole of the separation apparatus 4 returns into the inactive position as shown in FIG. 1. The lever 5 then rotates in a clockwise direction about axis 6, and the claw 13 returns into position retracted inside the profile of the wheels 17. The blank 1*b* previously stopped upstream by claw 13 is then released and is deposited on the downstream conveyor 3 moving at the speed of the upstream conveyor 2, passing beneath wheels 17.

Figure 5:
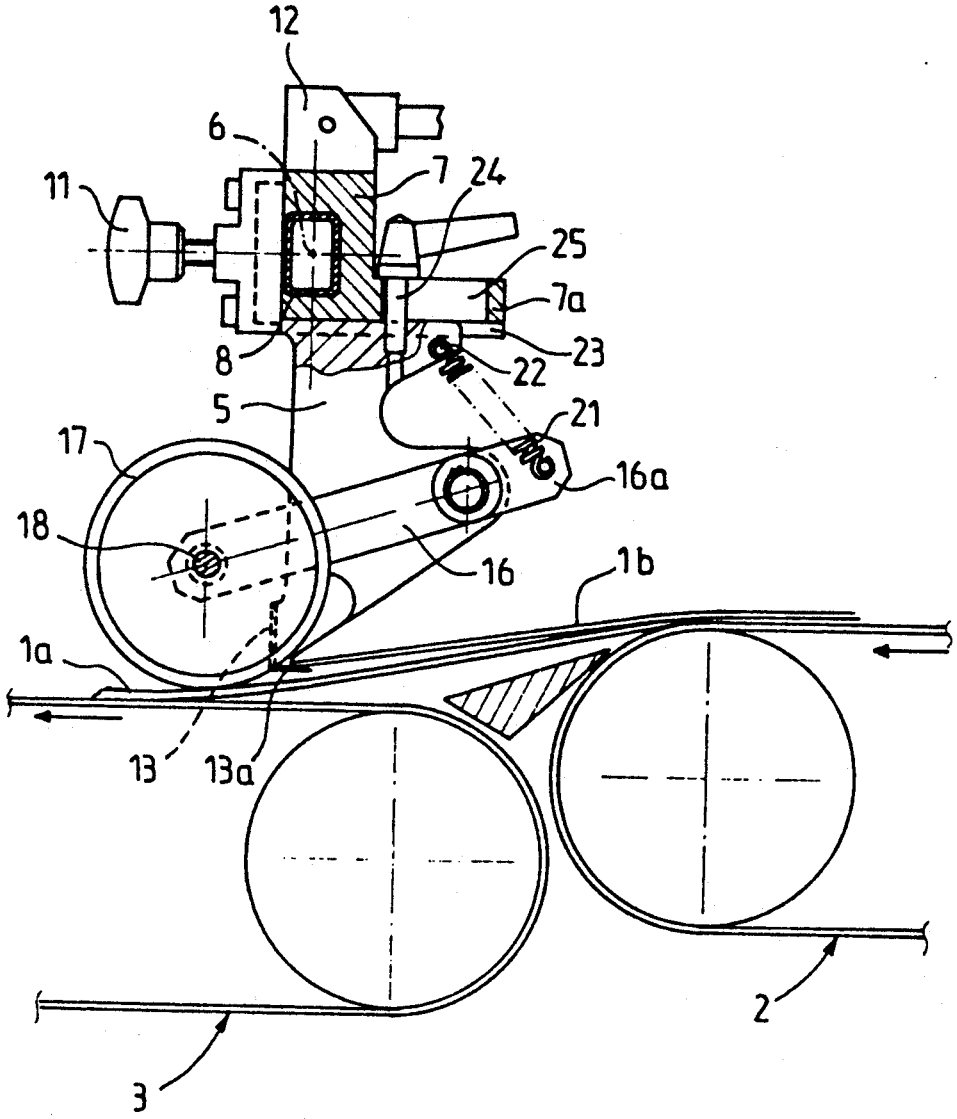
FIG. 5 is a view in a vertical, longitudinal section of a variant of the separation apparatus, in an intermediate position in the course of hooking the blanks.

In the variant embodiment shown in FIG. 5, the spring blades 19 are replaced by draw springs 21. However, in order elastically to urge each connecting rod 16, any other type of spring, particularly a compression or torsional spring, may also be used. Each draw spring 21 is hooked to an extension 16*a* of each rod 16 extending upstream and at an upper anchoring point 22 of the lever 5 in order permanently to stress each connecting rod 16 in the anti-clockwise direction. Furthermore, the lever 5 proper constitutes a separate piece independent of its hub 7 on which it is mounted to be adjustable longitudinally, i.e. in a plane perpendicular to its axis of rotation 6. The hub 7 presents, in its lower part, an extension 7*a* extending upstream. In the lower face of the hub 7 and its extension 7*a*, there is formed a slideway 23 in which the upper part of lever 25 is retained and may slide. The lever 5 is blocked in position beneath the hub 7 by means of a vertical screw 24 traversing an oblong slot 25 formed in the extension 7*a* and extended in a vertical, longitudinal plane. The screw 24 is screwed in a tapped hole provided in the upper part of the lever 5. Thanks to this device, it is possible to adjust the longitudinal position of the lever 5 and consequently of the claw 13 that it carries, in order optimally to stop the blanks of which the leading edge is not straight, particularly the blanks comprising tabs for gluing.

Although, in the foregoing description, it has been indicated that the separation apparatus 4 according to the invention is associated with two upstream (2) and downstream (3) conveyors aligned longitudinally but located at different levels, the upstream conveyor 2 being at a higher level than the downstream conveyor 3, it goes without saying that this separation apparatus 4 may also be used with two upstream (2) and downstream (3) conveyors located at the same level. Similarly, although it is advantageous to provide two conveyors 2, 3 in order to be able to place the downstream conveyor 3 in overspeed at the moment of separation, it may also be envisaged to use the separation apparatus 4 according to the invention with just one lower conveyor; and in that case, it suffices to determine the trajectory of the claw 13 of the lever 5 so that it is substantially tangential to the line of blanks and that the lower tooth 13*a* of the claw 13 may thus engage beneath the leading edge of the first blank having to be hooked and raised.

The apparatus according to the invention may also be used below the conveyor 3, in the event of the articles such as blanks la being transported whilst being maintained, by any appropriate means, against the lower sides of the conveyors 2, 3.

What is claimed is:

1. An apparatus for separating thin, flat articles, successively displaced in a continuous line, on at least one conveyor for creating downstream of the apparatus, groups of articles separated from each other by intervals in the line of articles, the apparatus further comprising:

a rotatable lever on said conveyor for hooking the articles;

said lever being rotatable relative to said conveyor about a first axis between an inactive position and an active position;

said lever including a claw for holding the flat articles and at least one connecting rod extending longitudinally downstream of the apparatus;

said connecting rod being mounted to and rotatable relative to aid rotatable lever about a second axis displaced with respect to said first axis;

said connecting rod including mounted thereto at a downstream part thereof at least one wheel extending longitudinally downstream and spring biased for pressing the flat articles located on said conveyor and under said connecting rod onto said conveyor; and spring means connecting said connecting rod and said lever for elastically urging and spring biasing said wheel against said articles in the direction of the movement of said conveyor downstream of said apparatus.

2. The apparatus of claim 1, wherein said spring means includes a spring having one end hooked to said connecting rod and another end hooked to said lever.

3. The apparatus of claim 2, including means mounting said spring for stretching thereof a larger amount when the lever is in said active position then in said inactive position thereof so that each said wheel exerts onto articles a pressing effort having value in the inactive position of said lever, lower than the value of the lever in the active position thereof.

4. The apparatus of claim 1, wherein said spring means includes a draw spring and means for hooking ends of said draw spring and said connecting rod.

5. The apparatus of claim 4 wherein said hooking means includes means for hooking at end of said draw spring to said lever and the other end of said draw spring to said connecting rod.

6. The apparatus of claim 1, wherein said spring means includes a cambered flexion blade having one end part anchored onto said lever and another end part abutting on said connecting rod.

7. The apparatus of claim 6, including a pin, an independent hub rotatable about said pin and having a slideway, means for mounting said lever for sliding movement in said slideway, and means for blocking said lever in position on the hub.

8. The apparatus of claim 1, including means for mounting said lever for longitudinal adjustment in a plane perpendicular to its axis of rotation.

9. The apparatus of claim 6, including a pin, an independent hub and means for mounting said lever for sliding movement in a slideway, of said independent hub, said hub being mounted to rotate about said pin, and means for blocking said lever in position on the hub.

10. The apparatus of claim 1, wherein said first and said second axes are transverse horizontal axes and are parallel to each other.

11. The apparatus of claim 1, wherein said spring means includes a draw spring and means for hooking the two ends of said spring to said lever and to said connecting rod.

12. The apparatus of claim 1, including means hooking one end of said spring means to said lever and for hooking the other end of said spring means to said connecting rod.

13. The apparatus of claim 1, including a transverse support rod and means for mounting said lever for sliding movement on said transverse support rod.

14. The apparatus of claim 1, including an independent hub having a slideway and means for mounting said lever for sliding in said slideway, means for mounting said hub for rotation about a pin, and means for blocking the lever in position on said hub.

15. The apparatus of claim 1, wherein said apparatus is located opposite an upstream end part of a downstream conveyor aligned with said upstream conveyor located at a level different from that of said downstream conveyor so that, in said active position, said claw engages in a gapping between two successive articles, said gapping resulting from a difference in level between said two conveyors.

16. The apparatus according to claim 1, wherein said active position is an article-hooking position.

17. The apparatus of claim 1, wherein said first and second axes are transverse horizontal axes.

* * * * *